United States Patent [19]

Brown

[11] 4,343,597

[45] Aug. 10, 1982

[54] RECIPROCATING FLUID PUMP HAVING A HALL SWITCH

[75] Inventor: Ralph V. Brown, Cayuta, N.Y.

[73] Assignee: Facet Enterprises, Inc., Tulsa, Okla.

[21] Appl. No.: 139,516

[22] Filed: Apr. 11, 1980

[51] Int. Cl.[3] ..... F04B 17/04; H02K 33/02

[52] U.S. Cl. ..... 417/417; 318/128

[58] Field of Search ..... 417/415-418; 318/128, 132; 310/31, 34; 123/617

[56] References Cited

U.S. PATENT DOCUMENTS

| | | | |
|---|---|---|---|
| 3,361,069 | 1/1968 | Long | 417/417 |
| 3,364,361 | 1/1968 | Burger | 91/275 X |
| 3,381,616 | 5/1968 | Wertheimer et al. | 417/417 |
| 3,515,966 | 6/1970 | DeValroger et al. | 310/31 X |
| 3,875,920 | 4/1975 | Williams | 123/617 |
| 4,080,552 | 3/1978 | Brown | 417/417 X |
| 4,122,378 | 10/1978 | Brown | 417/417 X |

FOREIGN PATENT DOCUMENTS

| | | |
|---|---|---|
| 1507604 | 4/78 | U.K. |
| 1322178 | 7/73 | U.K. |
| 1092872 | 11/67 | U.K. |
| 638362 | 6/50 | U.K. |

*Primary Examiner*—Carlton R. Croyle
*Assistant Examiner*—Edward Look
*Attorney, Agent, or Firm*—Remy J. VanOphem

[57] ABSTRACT

An electromagnetic fluid pump having a magnetic circuit responsive to a predetermined position of a reciprocating magnetically permeable piston is disclosed. The reciprocating piston closes the magnetic circuit at the end of its pumping stroke increasing the value of the signal produced by a hall effect switch. The increased value of the generated signal energizes a solenoid coil returning the piston to a cocked position against the force of a resilient member which urges the piston forward on its pumping stroke.

13 Claims, 6 Drawing Figures

RECIPROCATING FLUID PUMP HAVING A HALL SWITCH

BACKGROUND OF THE INVENTION

1. Field of the Invention

The present invention relates to the field of reciprocating electromagnetic devices, and in particular to a solenoid driven electromagnetic fluid pump having a magnetic circuit including a Hall effect switch detecting the position of a reciprocating piston.

2. Description of the Prior Art

Reciprocating piston electromagnetic fluid pumps as disclosed in the patent to Parker, U.S. Pat. No. 2,994,792, and Wertheimer, U.S. Pat. No. 3,381,616, have obtained wide commercial acceptance, but in a highly competitive field, improvements are very important. The earlier models of these pumps, as represented by Parker include an electrical switch in circuit relationship with a solenoid which is either mechanically or magnetically actuated by the piston at the end of the pumping stroke. Closing the switch energizes the solenoid retracting the piston to its cocked position. When the piston reaches the cocked position, the switch opens, de-energizing the solenoid and the pumping stroke is carried out under the force of a compressed spring. Although these types of pumps function very satisfactorily and have reasonable operating life, the electrical switch is subject to failure and is determinative of the pumps operating life.

To increase the life of the pump, blocking oscillators were subsequently introduced such as taught by Wertheimer and by Brown in U.S. Pat. No. 3,629,674. Blocking oscillators eliminated the electrical switch and increased the operating life of the pump. Pumps with blocking oscillators however are more complex since they require a detection coil in addition to the solenoid coil. Further, the operating temperatures of the pump were limited to the operating temperature range of the blocking oscillator.

The present invention is a reciprocating piston electromagnetic pump in which the electrical switch is replaced by a Hall effect switch in a magnetic circuit.

SUMMARY OF THE INVENTION

The present invention is an electromagnetic fluid pump having a magnetic circuit, including a Hall effect switch. The magnetic circuit is opened and closed by the pumps reciprocating magnetically permeable piston. When the reciprocating piston is at the end of its pumping stroke, it completes the magnetic circuit thereby increasing the magnetic field passing through the Hall effect switch. The magnitude or level of the output signal generated by the Hall effect switch increases in response to the increased magnetic field. The increased value of the output signal activates an electronic switch circuit energizing a solenoid coil. The energized solenoid coil retracts the pump's piston against the force of a spring to its start or cocked position. Retraction of the pump's piston to its start position opens the magnetic circuit, substantially decreasing the output signal generated by the Hall effect switch. The electronic switch circuit responds to the decreased value of the signal and deenergizes the solenoid coil. Thereafter, the spring urges the piston forward on a pumping stroke. When the piston again reaches the end of the pumping stroke, the magnetic circuit is again closed and the cycle is repeated.

The objective of the invention is an electromagnetic fluid pump having a Hall effect switch detecting the end of the piston's pumping stroke. Another objective of the invention is a pump having a longer operating life. Still another objective of the invention is a pump having a detection device having no moving mechanical parts.

These and other advantages of the invention will become obvious from a reading of the specification in conjunction with the drawings.

DETAILED DESCRIPTION OF THE INVENTION

Figure 1:
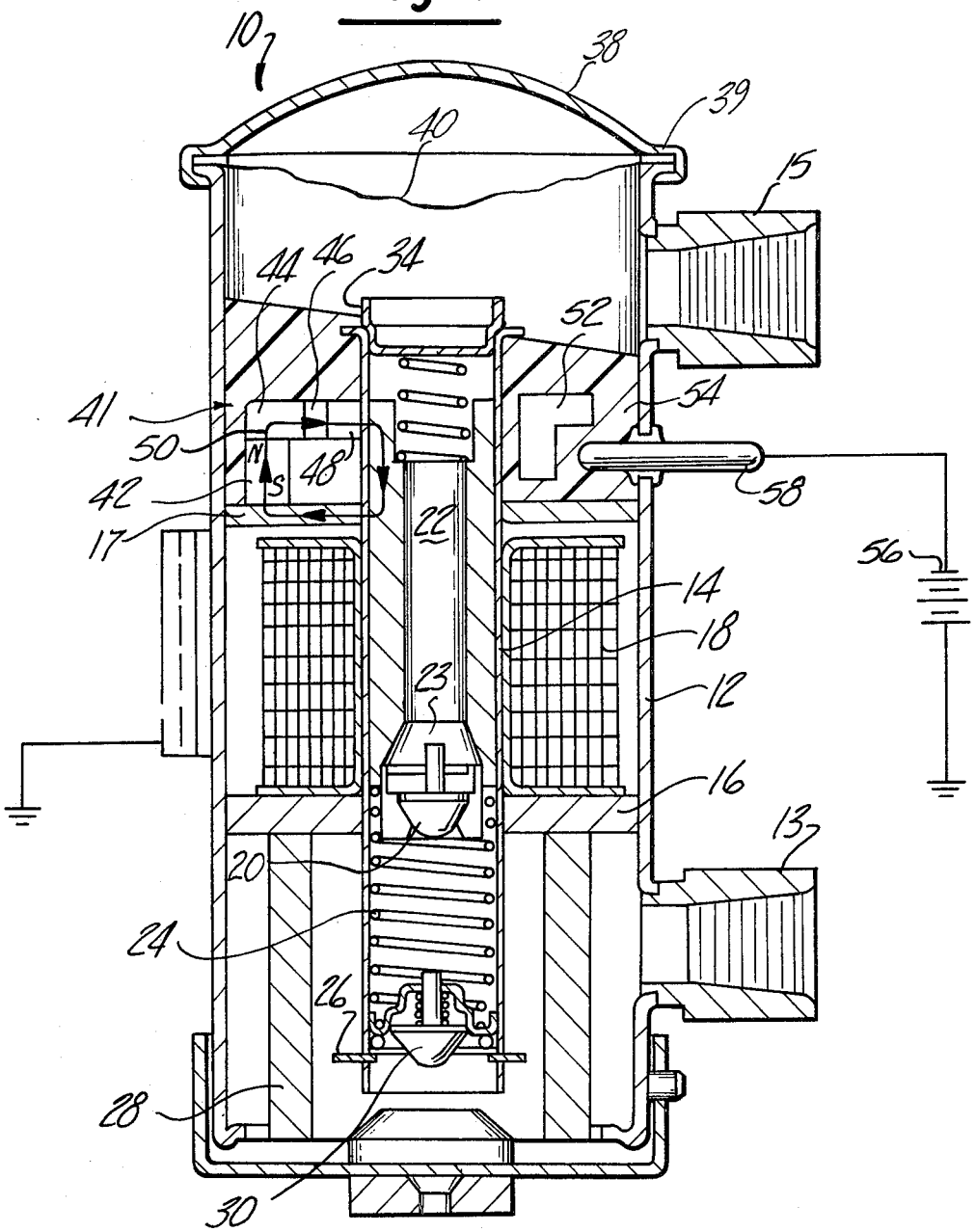
FIG. 1 is a cross section of an electromagnetic pump incorporating the invention.

Referring to FIG. 1, the numeral 10 indicates generally an electromagnetic fluid pump having a cylindrical housing 12 with a fluid inlet 13 and fluid outlet 15. Contained within the housing 12 is a non-magnetic guide or cylinder member 14 which is supported within the housing by pole members or annuli 16 and 17. Disposed intermediate the pole members 16 and 17 is a solenoid coil 18 circumscribing guide member 14. A hollow magnetic permeable piston member 22 is disposed inside the guide member 14 and is free to reciprocate therein. A one way valve 20 is disposed at the inlet 23 end of the piston member 22. A second one way valve 30 is disposed at the inlet end of the guide member 14. The action of one way valves 20 and 30 combine in a known manner to provide a unidirectional fluid flow through guide member 14 from the inlet 13 to the outlet 15 when the piston is reciprocated. A spring 24 is compressively disposed within the guide member 14 between the piston member 22 and the one way valve 30. A lock ring 26 restrains the movement of the valve 30 in a direction away from the piston 22. A filter member 28 may be disposed in the housing 12 between the fluid inlet 13 and the lower end of the guide member to filter out contaminants which could otherwise foul the operation of the pump.

An abutment member 34 is fixedly attached to the upper end of the guide member 14 and compressively confines a spring 36 between itself and the upper end piston 22. Spring 36 provides a cushion for the piston member as it approaches the end of its pumping stroke. A cap member 38 is clamped or otherwise fitted over the top of the housing 12 as shown at 39 to provide a fluid tight seal. A flexible diaphragm 40 is rigidly attached to the cap member 38 to suppress peak fluid pressure pulses generated by the reciprocating piston. The pump configuration described thus far is identical to the pump illustrated and described in my earlier U.S. Pat. No. 4,080,552, "Hybrid Blocking Oscillator for an Electromechanical Pump" and represents a basic configuration of an electromagnetic fluid pump.

Fixedly attached to the upper pole member 17 is a magnetic circuit 41 including a magnet 42 having one of its poles adjacent to pole member 17. An auxiliary pole member 44 is fixedly attached to the opposite end of magnet 42. A Hall effect switch 46, is affixed to the end of the auxiliary pole member 44. A connecting pole member 48 is fixedly disposed between the Hall effect switch 46 and the guide member 14. Auxiliary pole member 44 and connecting pole member 48 are made from a magnetic permeable material such as soft iron or one of the new iron alloys. The surface of the connecting pole adjacent to guide member 14 is contoured to mate with the cylindrical surface of the guide member. The magnet 42, upper pole member 17, auxiliary pole member 44, Hall effect switch 46 and connecting pole member 48 form a first portion of the magnetic circuit 41 which is completed by the piston 22 at the end of its pumping stroke. The arrow 50 shows the path of the magnetic flux lines when the magnetic circuit is completed by the piston 22. In this state, the magnetic field across the Hall effect switch is maximum and the Hall effect switch generates a maximum output signal. An electronic switch circuit 52 is encapsulated in epoxy 54 at a convenient location on the opposite side of the guide member and receives the output signal from the Hall effect switch 46. Electrical power from an external source, such as battery 56 is received by the electronic switch circuit 52 through an insulated feedthrough 58 passing through the housing 12. The opposite pole of the battery is connected to the pump housing 12 through a common ground.

Figure 2:
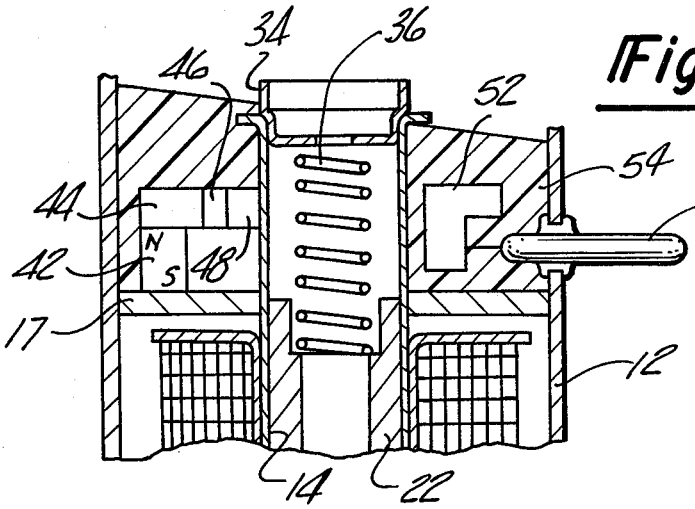
FIG. 2 is a partial cross section of the pump with the reciprocating piston in the cocked position.

FIG. 2 is a cross section which shows only the portion of the pump in the immediate vicinity of the magnetic circuit. In FIG. 2, the piston 22 is in its retracted or cocked position. The top of the piston 22 is no longer adjacent to the connecting pole member 48, thereby creating an air gap between the piston 22 and the connecting pole. This effectively opens the magnetic circuit and reduces the intensity of the magnetic field across the Hall effect switch 46 with an attendant decrease in its output signal.

Figure 3:
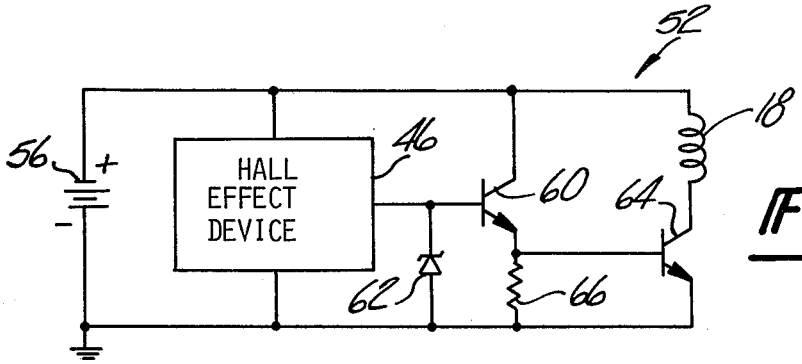
FIG. 3 is a circuit diagram of the electric switch circuit.
Figure 4:
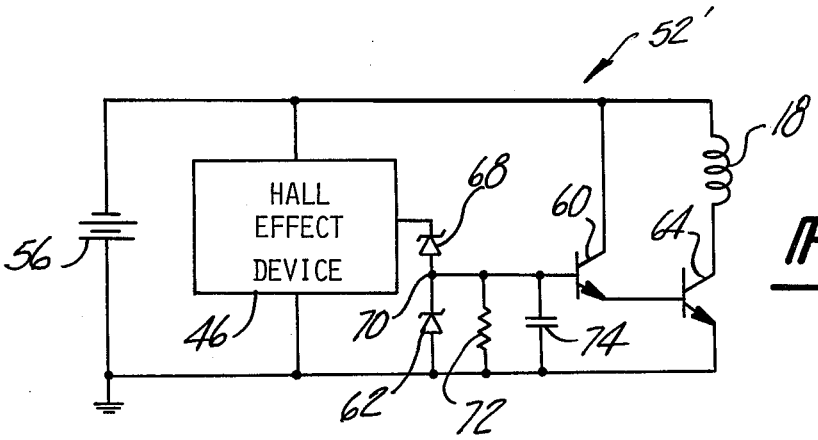
FIG. 4 is an alternate configuration of the electronic switch circuit.

The details of the electronic switch circuit 52 are illustrated in FIGS. 3 and 4. The circuits shown in FIGS. 3 and 4 represent two different circuits that may be activated by the output signal from the Hall effect switch 46. It is recognized that those skilled in the art will be capable of designing other circuits to perform the same basic function without departing from the spirit of the invention.

Referring now to FIG. 3, there is shown a first electronic switch circuit controlling the current flow through the solenoid coil 18. As previously indicated, the circuit is energized by a source of electrical power, such as battery 56. The positive pole of the battery is connected to one input of the Hall effect switch 46, the collector of transistor 60 and to one end of the solenoid coil 18. The negative pole of the battery is connected to a common ground. A second electrode of the Hall effect switch 46 is connected to the common ground. The output of the Hall effect switch is connected to the base of transistor 60, and to ground through Zener diode 62. The emitter of transistor 60 is connected to the base of a second transistor 64 and to ground through resistance 66. The other end of the solenoid coil is connected to the collector of the second transistor 64 whose emitter is connected to the common ground. Transistors 60 and 64 are connected in a modified Darlington arrangement.

The operation of the pump shall be discussed with reference to FIGS. 1 and 2 and the circuit diagram of FIG. 3. In its quiescent or unactivated state, the piston is urged to the end of its pumping stroke by the force generated by compressed spring 24 as shown in FIG. 1. In this state the piston 22 closes the magnetic circuit so that when electrical power is applied, the Hall effect switch 46 generates a high output signal. The high output signal applied to the base of transistor 60 causes it to become conductive providing base current for transistor 64. Transistor 64, in response to the base current provided by transistor 60, saturates and becomes fully conductive permitting a maximum current flow through solenoid coil 18. A current flow through solenoid coil 18 generates a magnetic field which pulls the piston back to its retracted or cocked position.

When the piston is retracted, the magnetic circuit is opened terminating the high signal generated by Hall effect switch 46. Terminating the high signal turns off transistor 60 and the base current being applied to the base of transistor 64. Transistor 64 becomes nonconductive deenergizing the current flow through solenoid coil 18. Thereafter, the piston 22 is urged forward again by spring 24 in a pumping stroke. The magnetic circuit is closed again when piston 22 reaches the end of its pumping stroke causing the Hall effect switch to once more generate a high output signal.

The circuit shown in FIG. 4 prevents pretriggering of transistors 60 and 64 prior to a predetermined output from the Hall effect switch 46. In this circuit, a second Zener diode 68 is placed in series arrangement with Zener diode 62. The junction 70 between the two Zener diodes is connected to the base of transistor 60 and to ground through resistance 72. A small capacitor 74 may be added as shown to maintain the conductance of transistor 60 for a short period of time after the magnetic circuit opens to assure the coil 18 will be energized for a period of time sufficient to retract the piston 22 to its cocked position.

The transistors 60 and 64 in this configuration are connected in the conventional Darlington arrangement with the emitter of transistor 60 connected directly to the base of transistor 64 and resistance 66 is omitted.

The operation of the circuit shown on FIG. 4 is as follows: With the piston at the end of its pumping stroke closing the magnetic circuit, the potential of the output of the Hall effect switch 46 is greater than the crossover potential of the Zener diode 68 providing a current flow to the base of transistor 60 causing it to conduct. Simultaneously, capacitor 74 will be charged. Zener diode 62 simultaneously limits the maximum potential that may be applied to the base of transistor 62 and the maximum charge stored by capacitor 74. The conductance of transistor 60 places transistor 64 into full conductance energizing solenoid coil 18. As the piston 22 is retracted by the energizing of the solenoid coil 18, the output signal generated by the Hall effect switch 46 starts to decrease. When the output signal generated by the Hall effect switch falls below the cross over potential of Zener diode 68, the Zener diode ceases to conduct. However, base current to transistor 60 continues to be provided by the discharge of the capacitor 74. The period of time transistor 60 is held in the conductive state after the output signal falls below the cross over potential of Zener diode 68 is determined by the R-C time constant of resistance 72 and capacitance 74. Transistor 60 remains conductive, supplying base current to transistor 64 until the capacitor 74 discharges to a predetermined value. This keeps solenoid coil 18 energized for a period of time sufficient to permit the piston to be retracted to its cocked position. Zener diode 68 continues to block base current to transistor 60 until the magnetic circuit is again closed by piston 22 and the Hall effect switch 46 generates a potential sufficiently high to cause Zener diode 68 to become conductive once again. The cross-over potential of Zener diode 68 is selected to be intermediate the output of the Hall effect switch with the magnetic circuit open and the magnetic circuit closed.

Figure 5:
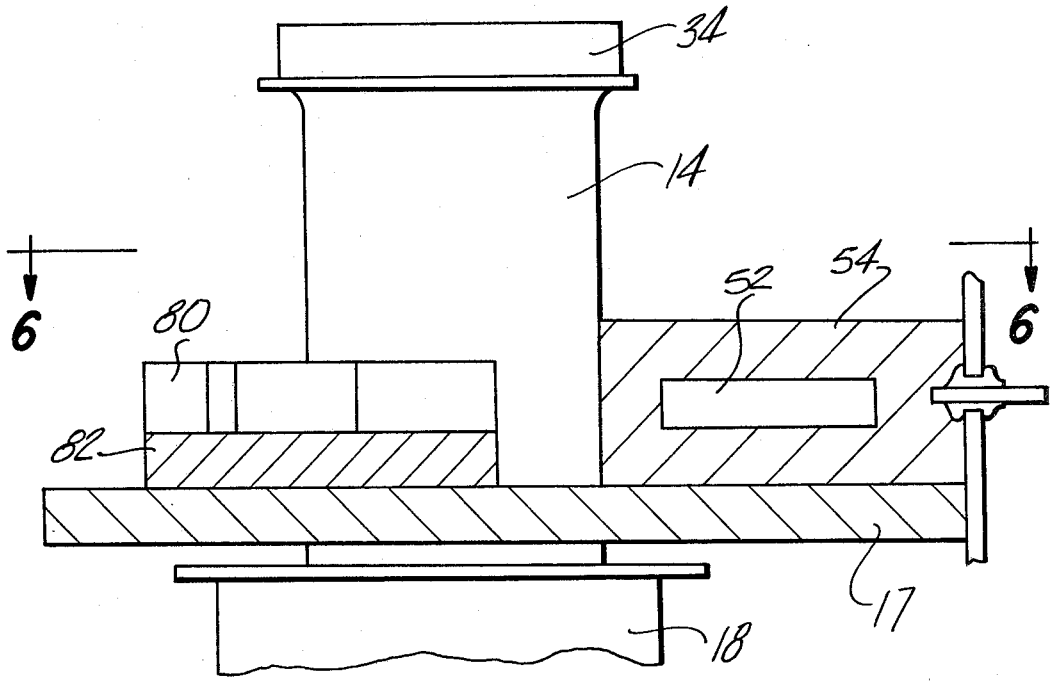
FIG. 5 is an alternate configuration of the magnetic circuit.
Figure 6:
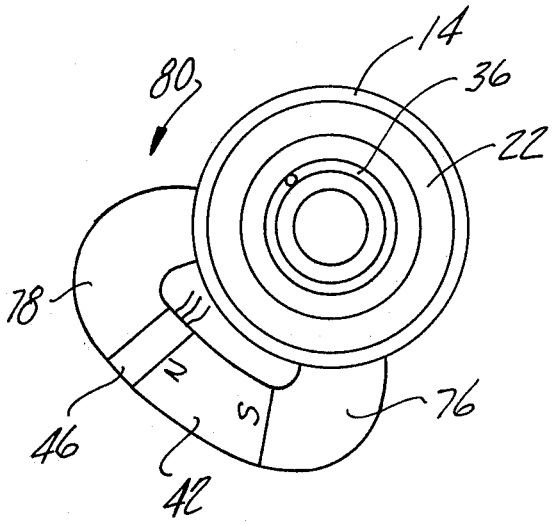
FIG. 6 is a top view of the alternate configuration.

An alternate arrangement of the magnetic circuit is illustrated in FIGS. 5 and 6. FIG. 5 is an internal side view of the pump showing a magnetic circuit 80 disposed in a plane normal to the axis of the guide member 14. The magnetic circuit 80 is supported above the pole member 17 by a non-magnetic spacer 82. The spacer 82 may be made from a non-magnetic material such as brass, aluminum, or a structural plastic.

The details of the magnetic circuit 80 are more clearly illustrated in FIG. 6. The magnetic circuit 80 comprises a magnet 42, a Hall effect switch 46, a first pole member 76 and a second pole member 78. The first and second pole members are made from a magnetic permeable material such as soft iron or any of the newer iron alloys.

The magnetic circuit 80 is completed (closed) when the piston 22 is at the end of its pumping stroke and is disposed between the first and second pole members 76 and 78, respectively.

The pump and its associated electronic switch circuit 52 controlling the current flow through the solenoid coil operate in the same manner as previously described with reference to the embodiment illustrated in FIGS. 1 and 2.

It is not intended that the invention be limited to the configurations of the pump, magnetic circuits, or electronic switch circuits illustrated and described herein. It would be obvious to those skilled in the art, that a magnetic circuit closed by a predetermined position of the piston may be incorporated into other pump configurations or used with other electromagnetic actuators having a reciprocating member corresponding to the piston. It would also be obvious to those skilled in the art that other arrangements of the magnetic circuit or electronic switching circuits could be used in place to those illustrated and discussed without departing from the spirit of the invention.

What is claimed is:

1. An electromagnetic fluid pump comprising:

an enclosed housing having an inlet port and an outlet port;

a non-magnetic cylindrical guide disposed in said housing defining a fluid flow path through said housing, said guide having one end proximate said inlet port and the other end proximate said outlet port;

a magnetically permeable hollow piston member disposed in said guide and free to reciprocate therein;

valve means for providing a unidirectional fluid flow through said guide proximate said outlet port;

biasing means for urging said piston member towards the end of said guide proximate to said outlet port;

solenoid coil means disposed concentrically about said guide for moving said piston member towards the end of said guide proximate said inlet port against the force of said biasing means;

magnetic circuit means disposed adjacent to the end of said guide proximate said outlet port, said magnetic circuit means completed by said piston member when said piston member is at the end of its pumping stroke;

Hall effect switch means disposed in series relationship with said magnetic circuit means for generating a signal in response to the magnitude of the magnetic flux flowing through said magnetic circuit means; and electronic switch means for energizing said solenoid means to move said piston member towards the end of said guide means proximate said inlet port in response to said signal having a predetermined magnitude.

2. The electromagnet fluid pump of claim 1 wherein said magnetic circuit means comprises:

a magnet having at least 2 poles of opposite polarity; and at least one magnetically permeable pole member having one end attached to one pole of said magnet, the other pole of said magnet and the opposite end of said pole member disposed adjacent to said guide at two spatially separated locations.

3. The electromagnetic pump of claim 2 wherein said Hall effect switch means is disposed in said magnetic circuit intermediate said magnet and said at least one pole members.

4. The electromagnetic pump of claim 3 wherein said two spatially separated locations are disposed parallel to axis of said cylindrical guide.

5. The electromagnetic pump of claim 4 wherein said two spatially separated locations are angularly disposed with respect to each other along a common plane normal to the axis of said cylindrical guide.

6. The electromagnetic pump of claim 3 wherein said electronic switch means is a transistor amplifier connected in series with said solenoid coil between a source of electrical power and a common ground, said transistor controlling the current flowing through said solenoid coil in response to the signal from the Hall effect switch.

7. The electromagnetic pump of claim 6 wherein said solenoid coil has an input end receiving electrical power from an external source and an output end, said transistor amplifier is a Darlington amplifier comprising a first transistor having a base receiving the signal generated by the Hall effect switch and an emitter connected to the base of a second transistor, said second transistor having a collector connected to the output end of said solenoid coil and an emitter connected to a common ground.

8. The electromagnetic pump of claim 7 wherein said electronic switch means further includes a Zener diode connected between the base of said first transistor and said common ground for limiting the maximum signal applied to the base of said first transducer.

9. The electromagnetic pump of claim 8 wherein said electronic switch circuit further includes a second Zener diode connected between the base of said first transistor and said Hall effect switch to block any signal received from said Hall effect device below a predetermined value.

10. The electromagnetic pump of claim 9 wherein said electronic switch further includes an R-C network connected to the base of said first transistor to maintain the conductance of said first transistor for a predetermined period of time after the signal from said Hall effect switch decreases from a value above said predetermined value to a value below said predetermined value.

11. A method for reciprocating a magnetically permeable member in an electromagnetic device having a resilient member urging said magnetically permeable member in one direction along a predetermined path and a solenoid coil pulling said magnetically permeable member in the opposite direction against the force of said resilient member comprising the steps of:

generating a magnetic field having a maximum flux density when said magnetically permeable member is displaced to a predetermined position in response to the urging of said resilient member;

detecting the flux density of said magnetic field with a Hall effect switch disposed in series with said magnetic field to generate a signal having a value corresponding to the flux density of said magnetic field; and activating an electronic switch in response to said signal having a maximum value indicative to said predetermined position, said electronic switch energizing the solenoid field to pull said magnetic permeable member in the opposite direction against the force of the member and away from said predetermined position.

12. The method of claim 11 wherein said method further includes the step of blocking with a Zener diode the signals generated by said Hall effect switch when said signals are below a predetermined value.

13. The method of claim 11 further including the steps of:

charging a capacitor in response to the signals from said Hall effect switch having a value greater than predetermined value to generate a delay signal; and activating said electronic switch with said delay signal to maintain the solenoid coil in an energized state for a predetermined period of time after the signal generated by said Hall effect switch falls below said predetermined value.

* * * * *

UNITED STATES PATENT AND TRADEMARK OFFICE

CERTIFICATE OF CORRECTION

PATENT NO. : 4,343,597

DATED : August 10, 1982

INVENTOR(S) : Ralph Vernon Brown

It is certified that error appears in the above-identified patent and that said Letters Patent is hereby corrected as shown below:

Column 1, line 28, delete "pumps" and insert - - - pump's - - -.

Column 1, line 51, delete "pumps" and insert - - - pump's - - -.

Column 2, line 40, delete "23 end" and insert - - - end 23 - - -.

Column 2, line 56, after "end" insert - - - of - - -.

Column 4, line 61, after "to" insert - - - the - - -.

Column 5, line 45, delete "to" and insert - - - of - - -.

In The Claims:

Column 6, line 57, delete "transducer" and insert - - - transistor - - -.

Signed and Sealed this

*Twenty-sixth* Day of *July 1983*.

[SEAL]

*Attest:*

GERALD J. MOSSINGHOFF

*Attesting Officer*

*Commissioner of Patents and Trademarks*